166-66 SR

7/5/77 XR 4,033,413

United States Patent [19]

Rogers

[11] 4,033,413

[45] July 5, 1977

[54] WIRE LINE WELL TOOL AND METHOD

[75] Inventor: Austin S. Rogers, Houston, Tex.

[73] Assignee: W. R. Grace & Co., New York, N.Y.

[22] Filed: Dec. 4, 1975

[21] Appl. No.: 637,676

Related U.S. Application Data

[62] Division of Ser. No. 465,081, April 29, 1974, Pat. No. 3,942,373.

[52] U.S. Cl. ..... 166/301; 166/66; 166/255; 166/64

[51] Int. Cl.[2] ..... E21B 47/02; E21B 47/06; E21B 47/12

[58] Field of Search ..... 166/65 R, 66, 64, 301, 166/250, 255

[56] References Cited

UNITED STATES PATENTS

| | | | |
|---|---|---|---|
| 2,305,261 | 12/1942 | Kinley | 166/301 X |
| 2,316,361 | 4/1943 | Piety | 166/66 UX |
| 2,814,019 | 11/1957 | Bender | 166/66 X |
| 2,998,067 | 8/1961 | Kerver | 166/301 |

*Primary Examiner*—Stephen J. Novosad
*Attorney, Agent, or Firm*—William Kovensky

[57] ABSTRACT

A new and improved wire line operated well tool apparatus and method utilizing a downhole transformer for sensing and testing conditions in a well, such as temperature, incline, and the like.

5 Claims, 6 Drawing Figures

WIRE LINE WELL TOOL AND METHOD

This application is a division of my copending application Ser. No. 465,081, filed Apr. 29, 1974, entitled "Well Tool Apparatus and Method", assigned to the same assignee as this application, and which is now U.S. Pat. No. 3,942,373, issued Mar. 9, 1976.

BACKGROUND OF THE INVENTION

1. Field of the Invention

The present invention relates to improved means for testing conditions in well bores.

2. Description of Prior Art

Prior art well testing apparatus, as exemplified by U.S. Pat. Nos. 2,686,039; 2,689,920; 2,717,039; 2,814,019; 2,817,808; 2,869,072; 3,004,427; 3,006,186; 3,095,736; and 3,233,170, have been used to locate the freepoint, or location at which pipe or tubing was stuck, in a well bore. Several problems have existed in the prior art, including accuracy of the readings obtained, alignment or placement of the freepoint sensor at a proper null or reference, and those created when a back-off tool was used to loosen the stuck pipe in conjunction with freepoint sensing. Isolation between electrical circuits of the freepoint indicator and back-off tool, necessary from a safety standpoint, was often difficult to maintain. Further, the shock formed when the back-off tool was used to loosen pipe often damaged the relatively sensitive downhole electronic circuits in the freepoint indicator.

Further problems have arisen for those tools when used in recently drilled wells which generally extend to greater depths than prior wells. Heat at these greater depths significantly limited the operation of the electronics used in the well tools, particularly in the freepoint indicators. The increased length of wireline necessary to lower the tools to the greater depths has increased the electrical resistance of the wireline, requiring an increase in the electrical current sent from the surface to insure operation of the backoff tool, thus increasing the voltage drop along the wireline.

SUMMARY OF THE INVENTION

Briefly, the present invention provides a new and improved well tool apparatus and method for sensing and testing conditions in a well bore and for performing certain operations in the well bore.

The present invention includes a magnetic rotor and stator and an intermediate core which form a magnetic circuit whose parameters vary, and thus vary the inductance of a coil, in response to movement of the pipe when stressed, with improved accuracy resulting during operations.

The apparatus and method the present invention further permit backoff and other operations in deeper wells notwithstanding the increased wireline resistance due to the increased depths, by using alternating current which is sent at a reduced current level down the wireline and increased in amplitude to a desired level by a transformer adjacent the backoff tool.

The present invention provides a new and improved apparatus for sensing temperature conditions in a well bore and metal creep and the like in pipe in the well bore due to these temperature conditions, as well as a new and improved inclinometer for sensing the degree of inclination of a well bore.

DESCRIPTION OF THE PREFERRED EMBODIMENT

Figure 1:
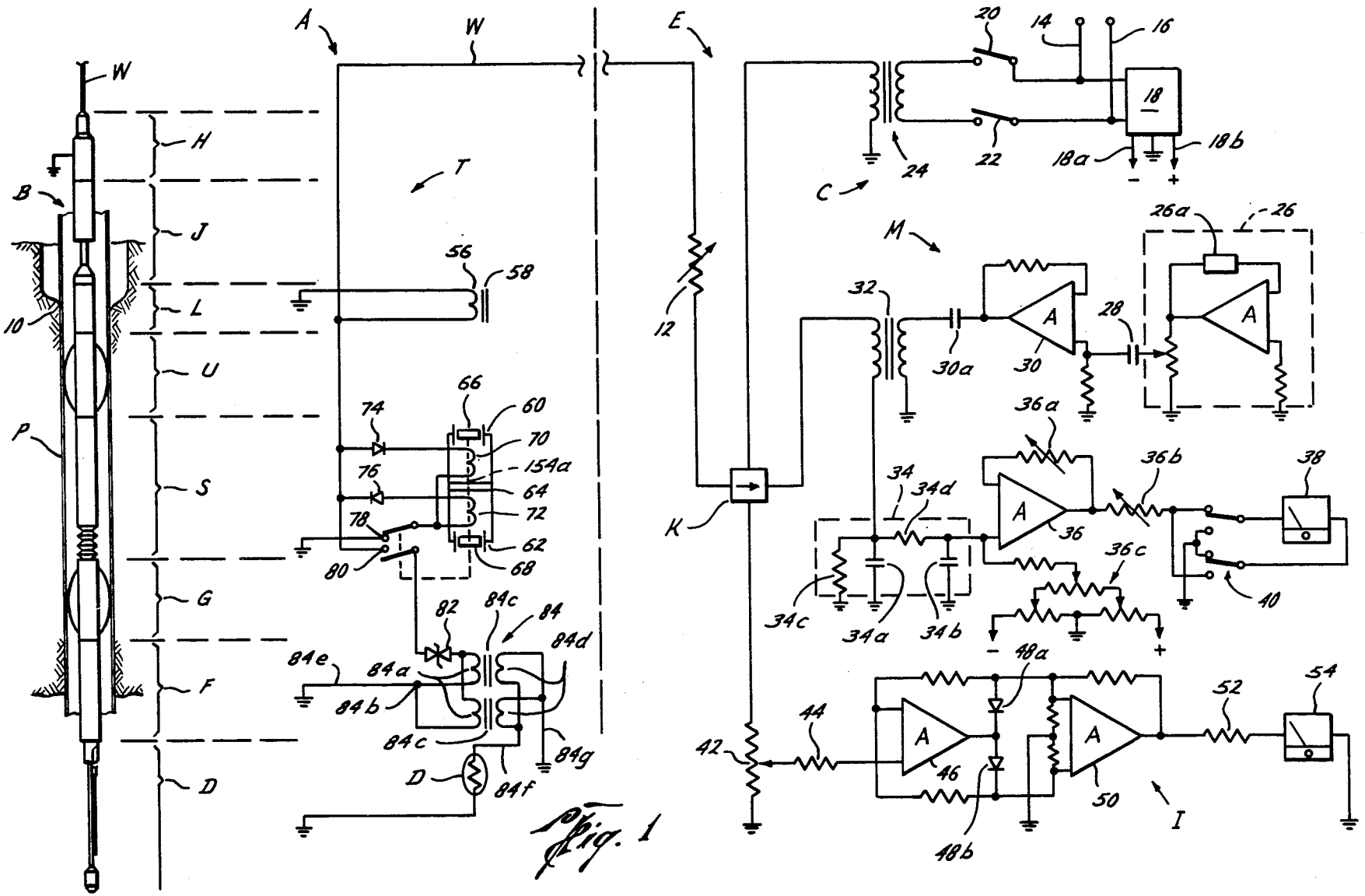
FIG. 1 is a schematic diagram of the apparatus of the present invention.

During drilling and other operations in a well bore B (FIG. 1), a pipe or casing P sometimes becomes stuck as indicated at 10 due to cave-ins and other subsurface earth movements and the like. In the drawings, the letter A (FIG. 1) designates generally the apparatus of the present invention for sensing and testing conditions at various test locations in the well bore B, which includes a surface electronic circuit E and a downhole tool T for use in the well bore B.

The downhole tool T is lowered through the well bore B by an electrically conductive wireline W. The tool T additionally has conventional sinker bars (not shown) mounted therewith in order to furnish additional weight to facilitate movement of the tool T through the pipe P in the well bore B.

The tool T includes a cable head subassembly, or sub, H which electrically connects the wireline W to the remainder of the tool T in the conventional manner. The cable head sub H has a conventional slip join J mounted therebeneath which forms a mechanical and electrical connection between the cable headset H and a conventional casing collar locator L.

An upper bowspring U and a lower bowspring G mount a sensor unit S between spaced upper and lower portions of the drill pipe P in the well bore B. As will be set forth below, and as shown in FIG. 1, when the drill pipe P is stuck at the test location, the sensor S detects that the pipe is so stuck by sensing lack of movement of the pipe P. Alternatively, when the pipe P is free at the test location, relative movement of the drill pipe P when stressed by torque or tension from the surface is transmitted to the sensor means S by the upper bowspring U and lower bowspring G indicating that the drill pipe P is free at the test location. The tool T is moved through the bore B to various locations during testing.

The sensor unit S thus indicates in a manner to be set forth below, the point where the drill pipe is stuck so that a detonator or backoff shot or other conventional backoff apparatus D may be used, as will be set forth, to free the drill pipe P above the stuck point. A transformer sub assembly F transfers power to the detonator D while increasing the electrical current level, so that the power consumption and voltage drop along the wireline W is reduced permitting operation of the detonator D at increased depths for deeper wells, while assuring that proper operating voltage and current levels are presented to the detonator D, as will be set forth.

The surface electronic circuit E includes a detonator control circuit and power supply C, a collar locator indicator circuit I and a sensor monitor circuit M which are selectively electrically connected to the downhole tool T by a multi-position control switch K through a variable resistor 12. The variable resistor 12 is adjusted for impedance matching with the resistance and impedance of the downhole tool T and wireline W.

The detonator control circuit C receives alternating current input power over input conductors 14 and 16 from a suitable alternating current source, such as a generator at the drilling rig or the like. A power supply circuit 18, a conventional voltage regulating direct current power supply, receives the incoming alternating current power from the conductors 14 and 16 and provides positive direct current bias potential at a positive output terminal 18*a* and negative direct current bias potential at a negative output terminal 18*b*. The power supply 18 thus provides operating direct current potential for the electronic circuits in the monitor circuit M and the indicator circuit I. The power supply 18 may be of the type providing plural direct current bias levels if the electronic components of the circuit E so require.

A first control switch 20 and a second control switch 22 of the detonator control circuit C electrically connect input alternating current power when closed from the input conductors 14 and 16 to a current reducing transformer 24 so that the detonator D may be energized when the control switch K is in the proper position. It is preferable to use two control switches 20 and 22 in order to prevent inadvertent depression of a single control switch causing operation of the detonator D at an improper time, although it should be understood that only one control switch in the control circuit C may be used, if desired. The current reducing transformer 24 reduces the current received over the input conductors 14 and 16 to a low level, so that the current sent through the control switch K and the wireline W to the detonator D is at a low level and thereby the voltage drop due to the resistance of the wireline W is reduced. The transformer F increases the current level from that received over the wireline W to a sufficiently high level to energize the detonator D.

The monitor circuit M of the surface electronics E includes a conventional operational amplifier oscillator circuit 26 providing output alternating current with a predetermined frequency through a coupling capacitor 28 and a buffer operational amplifier 30 to an isolation transformer 32. The oscillator 26 has an output frequency determined by the phase shift imposed on a portion of its output signal and fed back to its imput terminal through a conventional R-C feedback impedance network 26*a*.

The buffer amplifier 30 provides an impedance match between the oscillator 26 and the isolation transformer 32 and furnishes the output alternating current signal from the oscillator 26 through a coupling capacitor 30*a* to the transformer 32 so that the output signal from the oscillator 26 is furnished through the control switch K, when such switch is in the proper position, to the sensor unit S over the wireline W for freepoint sensing operations, to be set forth below. Isolation transformer 32 further prevents direct current offset signals formed in the sensor unit S during freepoint sensing from charging capacitor 30*a*.

The monitor circuit M further includes an integrator or low pass filter 34 which responds to the direct current offset signal formed by the sensor means S and accumulates charge in integrating capacitors 34*a* and 34*b* therein. A resistor 34*c* is connected in parallel with the capacitors 34*a* and 34*b* and a resistor 34*d* is connected in series between such capacitors to set a time constant for the integrator 34. The voltage represented by the stored charge in the capacitors 34*a* and 34*b* of the integrator circuit 34 is provided through an offset amplifier 36 having a control variable feedback resistance or potentiometer 36*a*, a variable calibration resistance or potentiometer 36*b* and a bias network 36*c* permitting a direct current voltmeter 38 to be set to a zero or null reading when the sensor unit S has been moved to the reference position, in a manner to be set forth below.

A two position switch 40 electrically connects the meter 38 to the output from amplifier 36 and the integrating network 34 so that positive and negative polarity direct current offset readings from the sensor unit S may be sensed by the monitor circuit M.

A gain control potentiometer 42 and input resistance 44 electrically connect the collar locator indicator circuit 1 through the control switch K to the collar locator L of the tool T. The potentiometer 42 is adjusted to set the current output level of the collar locator L furnished to the indicator circuit. The indicator circuit I includes an input amplifier 46 electrically connected through rectifying diodes 48*a* and 48*b* to a buffer amplifier 50 so that the alternating current output from the collar locator L is rectified and provided as a direct current signal through the amplifier 50 and a connecting resistor 52 to a direct current voltmeter 54 which provides a direct current output reading in response to the proximity of the collar locator L to a drill pipe collar in the drill pipe P, as is conventional in the art.

The electrical portion of the downhole tool T includes a coil 56 and magnetic core 58 of the collar locator L which responds to the proximity of the collar locator L to a casing collar generating an electromotive force (EMF) in the coil 56 which is sensed at the meter 54 of the indicator of the indicator I in the surface electronic portion E.

The sensor S is electrically connected through the wireline W and the line compensating resistance 12 through the multiposition control switch K to the monitor circuit M. The sensor S includes a first ferromagnetic stator core 60 operably connected through the upper bowspring U at a first point of contact to pipe P and a second, or lower, ferromagnetic stator core 62 which is also operably connected to the pipe P at the first contact point thereof by means of the upper bowspring U, as will be set forth below. The sensor unit further includes an intermediate ferromagnetic core 64 operably connected with the first contact point of the pipe along with the stator cores 60 and 62.

The sensor S further includes a first, or upper, ferromagnetic rotor core 66 and a second, or lower, ferromagnetic rotor core 68, each of which is operably connected with a second point of contact of the pipe P by means of the lower bowspring G spaced from the first point of contact with the pipe P. A first or upper inductive coil 70 is mounted between the first stator 60, the intermediate core 64 and the first rotor core 66. Similarly, a second inductive coil 72 is mounted between the second stator core 62, the second rotor core 68 and the intermediate core 64.

The stator core 60, the rotor core 66 and the intermediate core 64 form a ferromagnetic circuit whose reluctance and other ferromagnetic parameters change in response to relative movement between the first and second spaced points of contact with the pipe P, varying the inductance of the inductive coil 70 so that relative movement of the pipe P forms a current sensed by the monitor circuit M of the surface electronics E to indicate that the pipe P is not stuck at the test location. In a like manner, relative movement of the first and second spaced contact points of the pipe changes the parameters of the magnetic circuit formed by the second stator core 62, the second rotor core 68 and the intermediate core 64, varying the inductance of the inductive coil 72 to indicate relative movement of the spaced portions of the pipe P. As will be set forth below, the reference position mounting of the rotor cores and stator cores in the sensor S provides an accurate and sensitive indication of movement of the pipe P during freepoint sensing.

Figure 4:
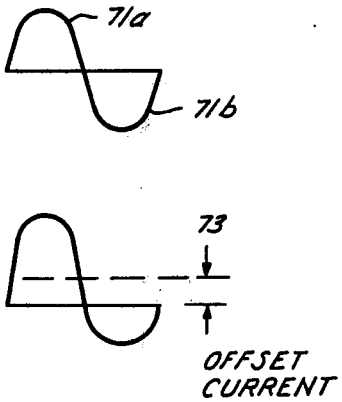
FIG. 4 is a schematic waveform diagram of voltage waveforms present in the apparatus of FIG. 1.

The sensor means S is energized by alternating current sent down from the oscillator 26 of the surface electronics E through the control switch K, the line compensating resistor 12 and the wireline W. Unidirectionally conductive diodes 74 and 76, or other suitable unidirectionally conductive circuit components energize the inductive coil 70 and the second inductive coil 72 on alternate half-cycles 71*a* and 71*b*, respectively, (FIG. 4) of the alternating current. Due to the alternate energization of the inductive coils 70 and 72, variations in the reluctance parameters of the ferromagnetic circuit in the sensor S due to relative movement between the upper bowspring U and lower bowspring G during freepoint testing result in an offset direct current, as indicated at 73, to be formed in the sensor S in response to movement of the pipe P. The polarity of the direct current offset further indicates the direction of movement of the pipe P. This direct current offset current provides increased accuracy freepoint readings and permits use of relatively temperature insensitive magnetic components in the sensor S, without requiring additional downhole electronics which are temperature sensitive and thus undesirable for use in deeper wells.

The downhole tool T is movable between a first operating position for sensing operations by the sensor S at a test location in the bore B and a second operating position for backoff operations by the detonator D at the test location. A sensor contact 78 completes an electrical circuit through the sensor S to an electrical ground when the downhole tool is in the first operating position, electrically connecting the sensor S to the wireline W by completing the electrical circuit therebetween. A backoff contact 80 electrically connects the detonator D to the wireline W when the downhole tool T is in the second operating position permitting backoff operations. The sensor contact 78 and the backoff contact 80 are mutually exclusively operable, electrically isolating the sensor means S from the detonator D during downhole operations. This electrical isolation between the sensor S and detonator D protects the ferromagnetic circuits of the sensor D from being excessively or permanently magnetized by the high voltage sent down the wireline W to activate the detonator D, and also prevents power loss in the sensor S by sensor loading during backoff operations insuring full power transfer to the detonator D from the wireline W.

A voltage threshold responsive means, such as a Zener diode 82, electrically connects the backoff contact 80 to a current increasing transformer 84 in the transformer sub F of the downhole tool T. The Zener diode 82 serves as further protection and isolation between the sensor S and the detonator D by preventing sensor voltage from the sensor S from firing the detonator D during sensing operations and other operations.

The transformer 84 has two primary coils 84*a* electrically connected in parallel between the Zener diode 82 and a tap 84*b* electrically connected by a return conductor 84*e* to ground. Two magnetic cores 84*c* magnetically link each primary 84*a* of the transformer 84 to a corresponding secondary coil 84*d* thereof. The secondary coils 84*d* are electrically connected by a conductor 84*f* to the detonator D and to electrical ground by a ground conductor 84*g*. The turns ratio between the primary coils 84*a* and secondary coils 84*d* of the transformer 84 is chosen to be a sufficiently large ratio, for example 20:1, so that the level of the electrical current sent from the control circuit C through the switch K over the wireline W to the detonator D is significantly increased in the transformer 84. In this manner, a low level current can be sent over the wireline W, decreasing the voltage drop due to the resistance in the wireline, reducing power loss therein, while insuring sufficient current to ignite the detonator D, particularly those detonators for high temperature well operations which require high current levels to ignite, and permit backoff operations in the well bore B once the stuck point of the pipe P has been located by the sensor S, in a manner to be set forth below. It should be understood that transformers with a single primary coil and secondary coil, or more than two sets of primary and secondary coils are also suitable for use with the present invention. The dual arrangement shown was used as a convenience only to fit the transformer into the successfully constructed embodiment.

The sensor S and time delay means are described in full detail in the above identified parent patent. To the extent the disclosure thereof is necessary to complete this disclosure, it is hereby incorporated by reference as if here set forth in full.

TRANSFORMER SUBASSEMBLY

Figure 2:
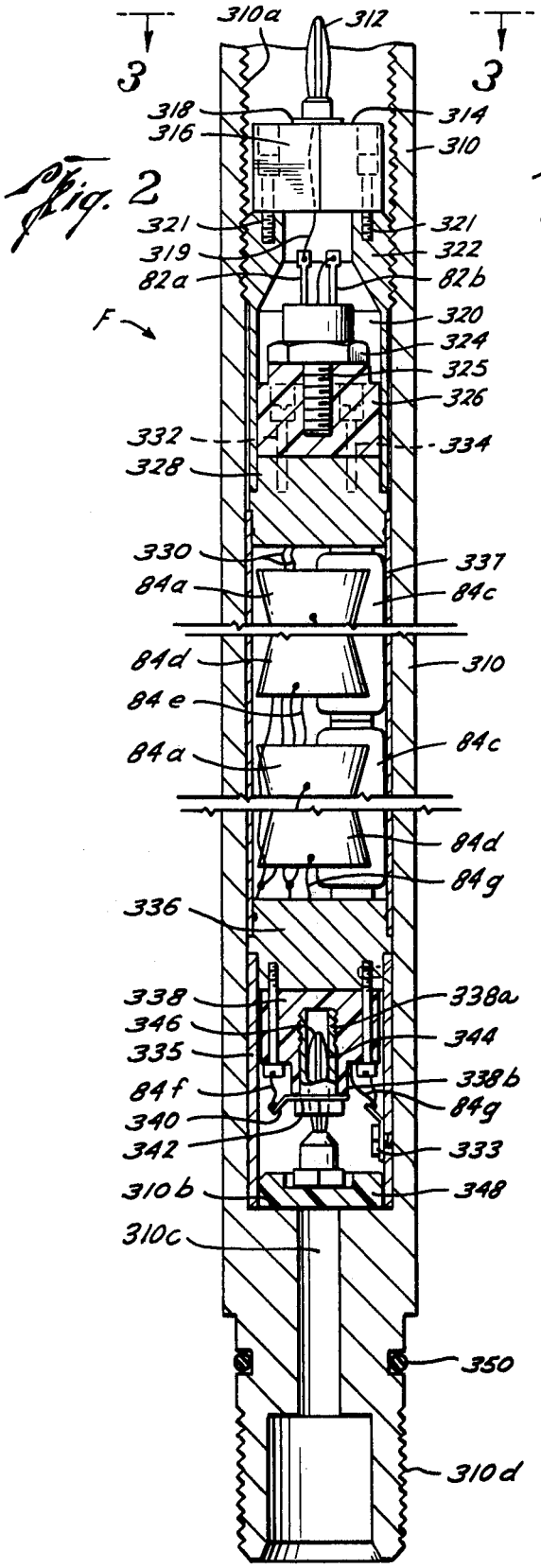
FIG. 2 is a side view taken partly in section of a transformer subassembly of the apparatus of FIG. 1.
Figure 3:
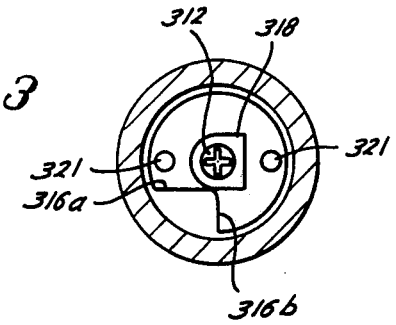
FIG. 3 is a cross-sectional view taken along the lines 3—3 of FIG. 2.

The transformer subassembly F (FIGS. 2 and 3) receives the reduced current level alternating current from the wireline W through the upper subassemblies including the slip joint J, the collar locator L, the upper bowspring U, the sensor subassembly S and the lower bowspring G. The transformer subassembly F is mounted along a threaded internal surface 310*a* of a subassembly housing 310 to a threaded lower portion (not shown) of the lower bowspring G. A banana plug 312 is inserted into a contact insert (not shown) mounted in the lower bowspring G, forming an electrical connection therebetween. The banana plug 312 is mounted with an upper surface 314 of an upper insulator plug insert 316. A pie-shaped portion of the insulator plug insert 316 is removed adjacent surfaces 316*a* and 316*b* (FIG. 3) to allow clearance for wires, etc. A solder lug 318 is formed extending outwardly from the banana plug 312 on the upper surface 314 of the insulator plug insert 316 in order that an electrical conductor 319 may electrically connect the banana plug 312 to a first contact 82*a* of the Zener diode 82. The contact 82*a* and a second contact 82*b* are formed extending upwardly from the Zener diode 82 into an interior hollow portion 320 of a spacer 322 which supports the insulating block 316. A pair of screws 321 are inserted into threaded sockets in the insulating block 316 and spacer 322 to mount the block 316 with the spacer 322.

The Zener diode 82 is mounted with a lock nut 324 which is engaged in a threaded socket 325 of an insulating spacer 326 above an upper plug 328. A set of screws 332 mounts the insulating spacer 326 with the upper plug 328.

A pair of electrical conductors 330 electrically connect the second contact **82*b* of the Zener diode 82 through the insulating spacer 326 to the input terminals of the pair of primary coils 84*a*. The conductors 330 preferably pass through suitable grooves (not shown) formed in spacer 326 and plug 328. A second conductive screw 334 in the plug 328** forms an electrical ground.

As has been set forth above, each of the primary coils **84*a* has an individual common core 84*c* magnetically linking primary coil 84*a* with a secondary coil 84*d*. The turns ratios of the primary coils 84*a* and the secondary coils 84*d* are chosen so that a significant increase in the current level sent down the wireline W is formed in the transformers 84 so that reduced current levels may be sent down the wireline W to increased depths and then increased in the transformer F to a sufficiently high level to operate the detonator D. A metallic sleeve 337 is mounted in the housing 310 to retain a suitable protective potting electrical resin for the transformer 84** therein.

The return conductor **84*c* (FIGS. 1 and 2) electrically connects the side of the primary coils 84*a* opposite the input terminals to a ground screw 333 mounted in a spacer sleeve 335, electrically grounding the primary coils 84. The return conductor 84*e* passes through suitable grooves (not shown) formed between the subassembly housing 310, the lower plug 336, a lower insulator 338 and the spacer sleeve 335**.

A lower plug 336 is mounted by set screws with the spacer sleeve 335 in the transformer subassembly 310, and a lower insulator 338 is mounted therewith by suitable screws 339 or other fastening means.

The conductor **84*f* (FIGS. 1 and 2) electrically connects an output terminal of secondary coils 84*d* of the transformer F to a contact tab 340. The ground conductor 84*g* electrically grounds the other terminal of the secondary coils 84*d* to the ground screw 333. The contact tab 340 is formed extending outwardly from a conductive disk 342. The conductive disk 342 is held in place adjacent a lower end 338*b* of the lower insulator 338 by a contact insert 344 having a threaded external surface for insertion into and engagement with a threaded internal surface formed adjacent a socket 338*a* in the lower insulator 338. A conventional banana plug 346 is mounted with its associated washer and lock nut atop a lower insulator mount 348 adjacent a lower surface 310*b* within the transformer housing 310. A conductor passage 310*c* is formed in the transformer housing 310 extending downwardly from the surface 310*b* to permit insertion of contact inserts or other suitable conventional electrical connectors so that electrical connection is provided between the banana plug 346** and the detonator subassembly D therebeneath.

A threaded external surface **310*d* is formed at a lower end of the transformer housing 310 in order that the transformer subassembly F may be mechanically connected with the detonator subassembly D therebeneath. An O-ring 350 or other suitable sealing means is mounted for sealing between the lower end of the transformer housing 310** and the detonator subassembly D.

In operation, as set forth in the above identified parent patent, the control switch K of the surface electronics E may be moved to electrically connect the control circuit C to the wireline W, and switches 20 and 22 are depressed sending alternating current through the current-decreasing transformer 24 through the wireline W, the shooting contact ring 190 and the shooting contacts 180 to the transformer sub F. The current increasing transformer coils **84*a*** in the transformer sub F increase the level of the current from the wireline W so that the sufficient amperage is present to ignite the detonator D and free the pipe P above the point where backoff operations are being performed.

TEMPERATURE SENSING APPARATUS

Figure 5:
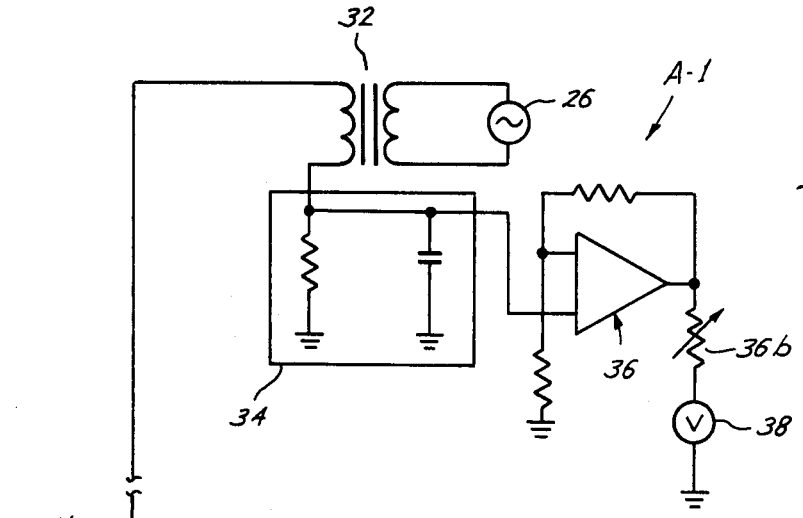
FIG. 5 is a schematic diagram of a temperature sensing apparatus of the present invention.

In a remote temperature sensing apparatus A-1 (FIG. 5) of the present invention, like structure and components to that of the apparatus A bear like reference numerals. In the apparatus A-1, the oscillator or alternating current source 26 sends electrical current through the isolation transformer 32 down the wireline W to a remote sensor S-1 mounted in a suitable capsule in the well bore for a sensing temperature conditions therein.

The remote sensor S-1 includes a first resistor 360 electrically connected between the unidirectionally conductive diode 74 and the electrical ground contact 78. The resistor 360 has a resistivity temperature coefficient of substantially zero, so that the resistance value thereof is substantially temperature invariant. The sensor S-1 further includes a second resistor 362 electrically connected between the ground contact 78 and the diode 76. The resistor 362 has a resistivity temperature coefficient of some finite number, such as four parts per thousand. The resistance value of the resistor 362 is selected to equal that of the temperature invariant resistance 360 at a predetermined temperature, for example 0° F. When the sensor S-1 is lowered into the pipe P of the well bore B to sense temperature conditions therein, the resistance value of the resistor 362 changes in accordance with the change in temperature therein, while the resistance value of the resistor 360 remains substantially constant. Accordingly, when the alternating current from the generator 26 is received over the wireline W for positive half-cycles through the diode 74, the current through the resistor 360 does not change. However, on the negative half-cycles through the diode 76, the current through the resistor 362 decreases, forming an offset current which can be monitored by the integrator 34 in the manner set forth above and the voltage level representing the accumulated offset current in the integrator 34 is amplified through the amplifier 36 and provided through the calibration resistor **36*b* to a meter 38** so that temperature conditions in the well bore may be sensed by the apparatus A-1.

INCLINOMETER

Figure 6:
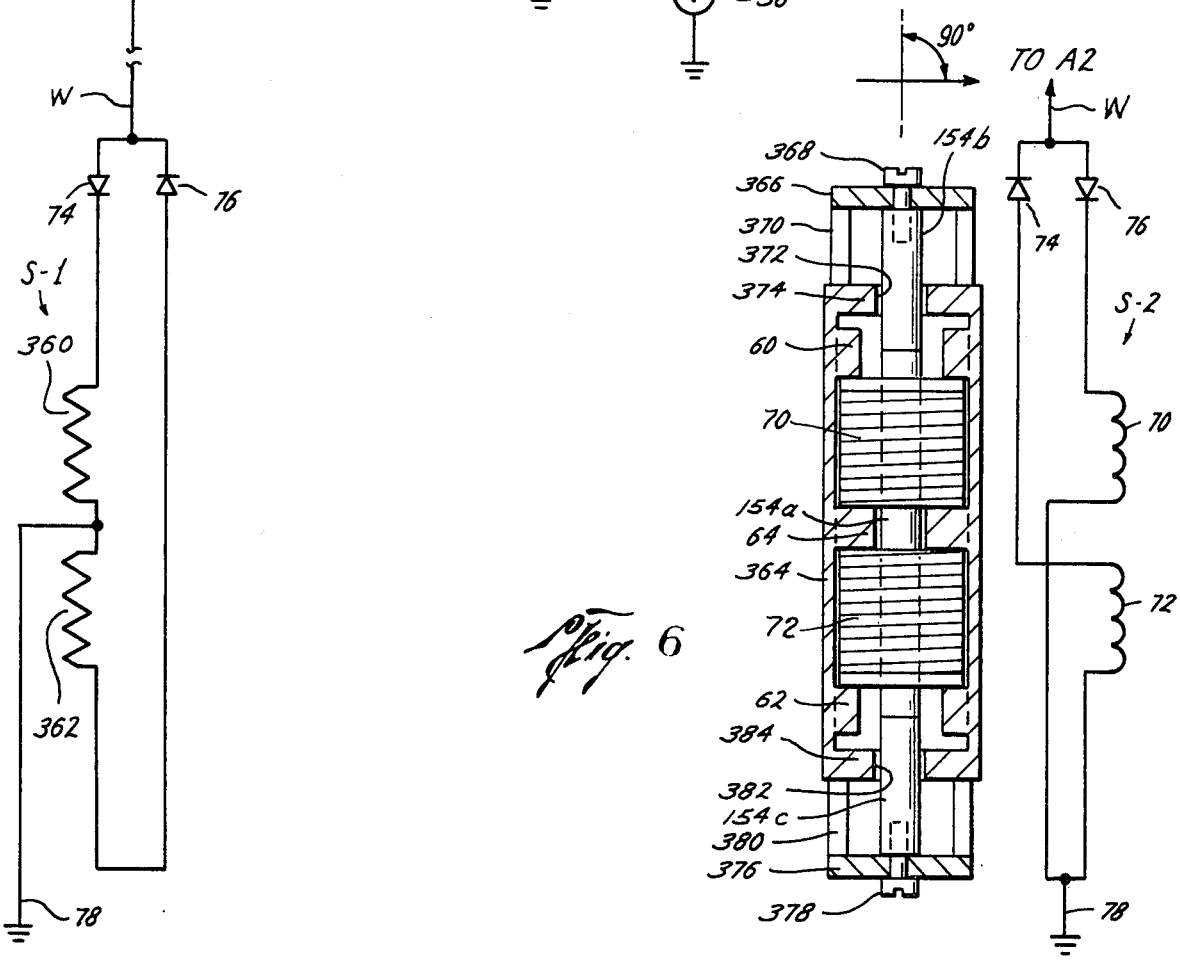
FIG. 6. is a schematic diagram of an inclinometer apparatus of the present invention.

In an inclinometer apparatus A-2 of the present invention (FIG. 6), like structure to that of the apparatus A and A-1 bears like reference numerals. The apparatus A-2 is used for sensing the inclination of a well bore.

The apparatus A-2 receives alternating current operating power from the generator or oscillator 26 which is provided through the isolation transformer 32 down the wireline W to an inclinometer S-2 of the apparatus A-2.

The sensor S-2 is a modified embodiment of the sensor S, being mounted in a ferromagnetic cylindrical case 364. The sensor S-2 has the upper and lower stator cores 60 and 62 and the intermediate core 64 forming a magnetic circuit in conjunction with the ferrous center portion 154*a* of the shaft 154.

The shaft 154 is mounted at the upper end 154*b* to a support leaf spring 366 by a screw 368. The support spring 366 engages a cylindrical spacer 370 at outer ends thereof and suspends the shaft 154 therebelow. The support shaft 154 extends from the support spring 366 through an enlarged opening 372 formed in a circular end plate 374 of the sensor S-2. The enlarged opening permits free movement of the shaft 154 with respect to the case 364 of the sensor S-2.

The shaft 154 is mounted at a lower end 154*c* with a second support leaf spring 376 by a screw 378 or other suitable mounting means. The support spring 376, in a like manner to the support spring 366 is mounted at outer ends thereof with a cylindrical spacer 380. The lower end 154*c* of the shaft 154 extends through an enlarged opening 382 formed in a lower end plate 384 of the sensor S-2.

The sensor S-2 is calibrated by having the shaft 154*a* mounted therein so that the inductance of the coils 70 and 72, as influenced by the magnetic circuits formed by the stators 60, 62 and 64 therein, is substantially equal when the sensor S-2 is vertically suspended. The sensor S-2 is mounted in a suitable casing and lowered into the pipe P and the well bore B by the wireline W. As the well bore B deviates from vertical, the weight of the shaft 154 exerting a downward force on the support spring 366 becomes less, due to the deviation from vertical, permitting the support spring 366 to move the shaft 154 upwardly, changing the reluctance parameters of the magnetic circuits affecting the coils 70 and 72, forming the offset current which is accumulated in the integrator 34 to provide a voltage level through the amplifier 36 and the calibrating resistance 36*b* to the meter 38 in order to indicate the deviation of the well bore B from true vertical.

The motions along the axis of the shaft 164 are very small, in the neighborhood of millionths of an inch or thousandths of an inch at the most. The compressability of the insulator caps on the coils 70 and 72 is sufficient to allow these small motions to in turn produce meaningful results in regard to inclination of the bore hole.

The foregoing disclosure and description of the invention are illustrative and explanatory thereof, and various changes in the size, shape, materials, components, circuit elements, wiring connections and contacts as well as in the details of the illustrated circuitry and construction may be made without departing from the spirit of the invention.

I claim:

1. A method of increasing the electrical current level to energize a wireline operated stuck pipe loosening apparatus in a well bore, comprising the steps of:

a. sending alternating current down the wireline to the pipe loosening apparatus at a reduced current level;

b. increasing the level of current received at the apparatus from the wireline; and c. energizing the pipe loosening apparatus with the increased current.

2. In an apparatus for loosening pipe which is stuck in a well bore when energized by an electrical current over a wireline from the surface, the improvement comprising:

means in said apparatus receiving the electrical current from the wireline and for increasing the level of current sufficiently to energize said apparatus, whereby reduced current levels may be sent from the surface, and whereby power loss in the wireline is reduced.

3. A combination structure, comprising stuck pipe loosening apparatus, a wireline for moving said apparatus in a well bore containing said pipe, said apparatus being operative to loosen pipe when energized by electrical current sent over said wireline from the surface, and means in said apparatus receiving the electrical current from the wireline and for increasing the level of current sufficiently to energize said apparatus, whereby reduced current levels may be sent from the surface, and whereby power loss in the wireline is reduced.

4. The structure of claim 3, wherein said means receiving the electrical current comprises:

a transformer receiving the electrical current from the wireline and increasing the current level.

5. The structure of claim 3, wherein a freepoint sensor is used with the pipe loosening apparatus and said means receiving the electrical current further includes:

voltage threshold responsive means mounted with said apparatus and lowered with said apparatus in the well bore for preventing voltage levels in said freepoint sensor from inadvertently operating the apparatus.

* * * * *

UNITED STATES PATENT AND TRADEMARK OFFICE

CERTIFICATE OF CORRECTION

PATENT NO. : 4,033,413

DATED : July 5, 1977

INVENTOR(S) : Austin S. Rogers

It is certified that error appears in the above–identified patent and that said Letters Patent are hereby corrected as shown below:

On the title page, left hand column, item (73), change the assignee from "W. R. Grace & Co." to --Homco International, Inc.--.

Signed and Sealed this

*Twenty-ninth* Day of *May 1979*

[SEAL]

*Attest:*

RUTH C. MASON
*Attesting Officer*

DONALD W. BANNER
*Commissioner of Patents and Trademarks*